US005779859A

United States Patent [19]

Carter et al.

[11] Patent Number: 5,779,859

[45] Date of Patent: Jul. 14, 1998

[54] METHOD OF IMPROVING FILLER RETENTION IN PAPERMAKING

[75] Inventors: Richard Douglas Carter; Britt Ciccrchi, both of Macon, Ga.

[73] Assignee: J.M. Huber Corporation, Edison, N.J.

[21] Appl. No.: 766,260

[22] Filed: Dec. 13, 1996

[51] Int. Cl.[6] ..... B21F 11/00; B21H 17/37; B21H 17/74

[52] U.S. Cl. ..... 162/183; 162/181.3; 162/181.8; 162/168.2; 162/175

[58] Field of Search ..... 162/183, 181.1, 162/158, 168.3, 168.2, 181.7, 175, 181.2, 181.3, 181.8, 141, 189, 190

[56] References Cited

U.S. PATENT DOCUMENTS

| | | | |
|---|---|---|---|
| 3,151,017 | 9/1964 | Bradford | 162/141 |
| 3,813,283 | 5/1974 | Urbas | 162/190 |
| 4,798,653 | 1/1989 | Rushmere | 162/168.3 |

OTHER PUBLICATIONS

R.D. Mather et al., "Production of Paper at High Filler Levels", Article, 1982 Papermakers Conference, 7 pages.

Mrs. A.J. Hayes, "Dream of Reality?", the Julius Grant–P-MATA Prize, Article, Engineers Workshop, May 23, 1995, 4 pages.

M.C. Riddell et al., "Three Developments at Wolvercote Paper Mill", Article, Apr., 1976, 5 pages.

*Primary Examiner*—Peter Chin
*Assistant Examiner*—Jose A. Fortuna
*Attorney, Agent, or Firm*—Dickinson Wright PLLC

[57] ABSTRACT

A method for improving retention of filler in papermaking systems includes a split stream feed to either the head box or fan pump of a papermaking system. The split stream divides the pulp flow into two streams, one stream having a retention aid and filler added thereto. The retention aid and filler-containing stream is then added back to the other stream upstream of the fan pump or head box. Treating only a portion of the overall pulp flow with the filler/retention aid lowers retention aid consumption, improves paper product appearance and maintains or increases filler retention during papermaking.

10 Claims, 4 Drawing Sheets

METHOD OF IMPROVING FILLER RETENTION IN PAPERMAKING

FIELD OF THE INVENTION

The present invention is directed to a method and apparatus for improving filler retention in papermaking and, in particular, to a method and apparatus which diverts a portion of the pulp slurry for filler and retention aid addition thereto prior to feeding the pulp slurry to a papermaking machine.

BACKGROUND ART

In the art of papermaking, a well known incentive includes increasing the amount of filler in the final paper product. This incentive can be driven by both a shortage of pulp for papermaking and pulp prices.

One method for increasing the filler content in paper is the use of chemical retention aids. Retention aids typically permit an increase in filler content by modifying the bonding relationship between the fiber in the pulp and the filler. Typically, filler particles are much smaller than most pulp fibers and are not effectively retained by filtration through the pulp matte as it forms on a papermaking machine. Retention aids include cationic starches, charge-biasing polymeric types such as amine or quaternary ammonium groups and polymeric bridging agents such as ionic, cationic or anionic polymers. Often times, different retention aids are added for synergistic improvements such as using both a low molecular weight cationic polymer and a high molecular weight anionic polymer.

FIG. 1 shows a typical prior art papermaking method using retention aids to increase filler retention. A portion of an overall papermaking apparatus is designated by the reference numeral 10 and is seen to include a thick stock machine chest 1, a fan pump 3, a head box 5, white water silo 7 and a papermaking machine 9. It should be understood that since this apparatus is well known in the art, a further detailed description of the components upstream of the machine chest 1 and downstream of the papermaking machine 9 are not included or deemed necessary for understanding of the invention.

In use, a filler 11 is added to a pulp slurry 13 to form a filler-containing pulp slurry 15 or the filler 11 is fed directly to the thick stock machine stock 1 or fan pump 3. The thick stock 17 is then fed to the fan pump 3. The white water recycle 19 from the silo 7 is also fed to the fan pump 3 to form the thin stock 21. The retention aid 23 is then added to the thin stock upstream of the head box 5 to increase retention of the filler during papermaking, typically past the screens and cleaners.

In a similar prior art system as described in the publication entitled "Three Developments at Wolvercote Paper Mill" by M. C. Riddell et al., Paper Technology and Industry, April, 1976, pages 76–80, the retention aid is a high molecular weight synthetic polymer with a specific charge density and the filler is a clay or calcium carbonate. Addition of the retention aid to the filler-containing pulp slurry results in preflocculation of the filler. Adding the retention aid at the head box minimizes shearing of the preflocculated filler and possible lowering of filler retention.

One problem with these types of papermaking systems occurs when using a pulp containing high amounts of anionic trash. When adding a cationic retention aid to a pulp containing high amounts of anionic trash, the cationic retention aid tends to become neutralized by the anionic trash present in the pulp. With this neutralization of the retention aid, the filler retention during papermaking is reduced.

A prior art solution to this problem has been the addition of more cationic retention aid. More specifically, a cationic coagulant is added to the pulp slurry upstream to the filling addition followed by addition of a retention aid at the head box after filler addition. This approach is not only expensive, with as much as $50.00 of chemical costs being added to the cost of paper, but can also be difficult to run on the paper machine and can lead to significant down time on the machine without very close machine monitoring. Moreover, with the increased operating costs, approaches of this type are usually limited to a special grade of paper wherein the manufacturer can recoup the increased operating costs through the value of the final paper product.

Another problem with the prior art system discussed above wherein preflocculation of the filler occurs due to the retention aid addition is the formation of large agglomerates which are mechanically entrapped in the paper web. Although filler retention as high as 99% can be obtained, this approach leads to very large particles which create a mottled appearance on the sheet and could also lead to dusting problems.

One solution to the creation of a mottled appearance on the sheet is applying shear to the preflocculated filler particles to reduce their size and effect on sheet appearance. However, this shearing process is difficult to control and also greatly reduces the retention of the filler material.

Referring now to FIG. 2, the effective shear on the retention of a preflocked filler clay and a standard retention aid treatment is shown. As expected, the preflocked filler treatment shows higher ash retention percentages than the standard treatment at low shear rates. However, increasing the shear rate to improve the surface appearance adversely effects the percent ash retained of the preflocked filler material. In fact, by the time sheet appearance is acceptable by increasing the shear rate to around 1000 RPM, the retention of filler is only marginally better for the preflocked filler than the standard treatment. However, if sheet appearance is not a problem, preflocked fillers can produce a significant cost savings over the standard treatment. However, the use of preflocked fillers is limited when seeking acceptable sheet appearance.

In view of the disadvantages noted above in the prior art, a need has developed to provide an improved method of maintaining or increasing filler retention while using lower amounts of retention aids and maintaining acceptable surface appearance.

In response to this need, the present invention solves the problems of the prior art discussed above by providing both a method and apparatus for improved filler retention in papermaking which not only reduces the amount of retention aids and cationic coagulants used but also maintains acceptable surface appearance in the paper product and provides high levels of filler retention.

SUMMARY OF THE INVENTION

Accordingly, a first object of the present invention is to provide a method and apparatus which increases filler retention in papermaking.

A further object of the present invention is to provide a method and apparatus which combines both improved filler retention and improved sheet appearance in papermaking, using lower amounts of retention aids and cationic coagulants.

Yet another object of the present invention is to provide a process that combines all of high filler retention levels, low retention aid use and good sheet appearance in papermaking.

The present invention, as another object, provides an apparatus for improving the filler retention in papermaking without sacrificing sheet appearance and increasing operating costs.

Other objects and advantages of the invention will be apparent as a description thereof proceeds.

In satisfaction of the foregoing objects and advantages, the present invention is an improvement over papermaking methods wherein fillers and retention aids are added to a pulp slurry and the filler and retention aid-containing pulp slurry is then fed to a paper machine. According to the inventive method, the pulp slurry is first separated into first and second streams prior to filler and retention aid addition. The filler and retention aid are then added to one of the two streams. The stream containing the filler and retention aid is then added back to the second stream to be further processed in the papermaking method. By practicing the inventive method, the adverse affects of high amounts of anionic trash in the pulp slurry are minimized.

The term "retention aid" is intended to encompass retention systems using single or multiple polymers systems such as cationic polymers including natural and synthetic materials, i.e., starch, anionic polymers, cationic polymers and those systems using microparticle technology based on silica or bentonite, e.g. Composil™. Any retention system capable of use in conventional or other types of pulp flow schemes would be suitable for use according to the invention.

Preferably, the pulp slurry is fed to a thick stock machine chest of a papermaking system and the slurry is separated into the first and second streams from the machine chest or downstream thereof. The first stream after receiving the filler and retention aid addition can then be merged with the second stream upstream of a fan pump. Alternatively, the filler and retention aid-containing first stream can be merged with the aid of an auxiliary fan pump into the thin stock pulp slurry exiting the fan pump, upstream of the papermaking system head box.

The filler can be one of a clay, calcium carbonate, talc, zinc sulfate, magnesium hydroxide, aluminum trihydrate, barium sulfate, calcium sulfate, titanium dioxide, precipitated silicate or silicas or any other known filler useful in papermaking. The retention aid can also be any known retention aid such as a cationic, anionic or non-ionic type or a combination thereof.

The separation of the pulp slurry into the two streams is preferably based on the percent amount of filler in the final paper product.

The invention is also an improvement over known apparatus. In these known apparatus, a thick stock machine chest is provided along with a fan pump, a head box, a papermaking machine and a water recycle system which recirculates white water from the papermaking machine to the fan pump. In this known system, a thick stock pulp flow line interconnects the thick stock machine chest and the fan pump and a thin stock pulp flow line interconnects the fan pump and a head box. The inventive apparatus provides a second thick stock pulp flow line which takes a portion of thick stock paper pulp for treatment, either from the machine chest or downstream thereof. Means for adding a filler and a retention aid to the second thick stock pulp flow line are provided. The thick stock pulp flow containing the filler and the retention aid is then merged with the other thick stock pulp flow line or the thin stock pulp flow line downstream of the fan pump. The merging of the thick stock pulp flow containing the filler and retention aid can be done using valves or other conventional components.

BRIEF DESCRIPTION OF THE DRAWINGS

Reference is now made to the drawings of the invention wherein.

DESCRIPTION OF THE PREFERRED EMBODIMENTS

Figure 1:
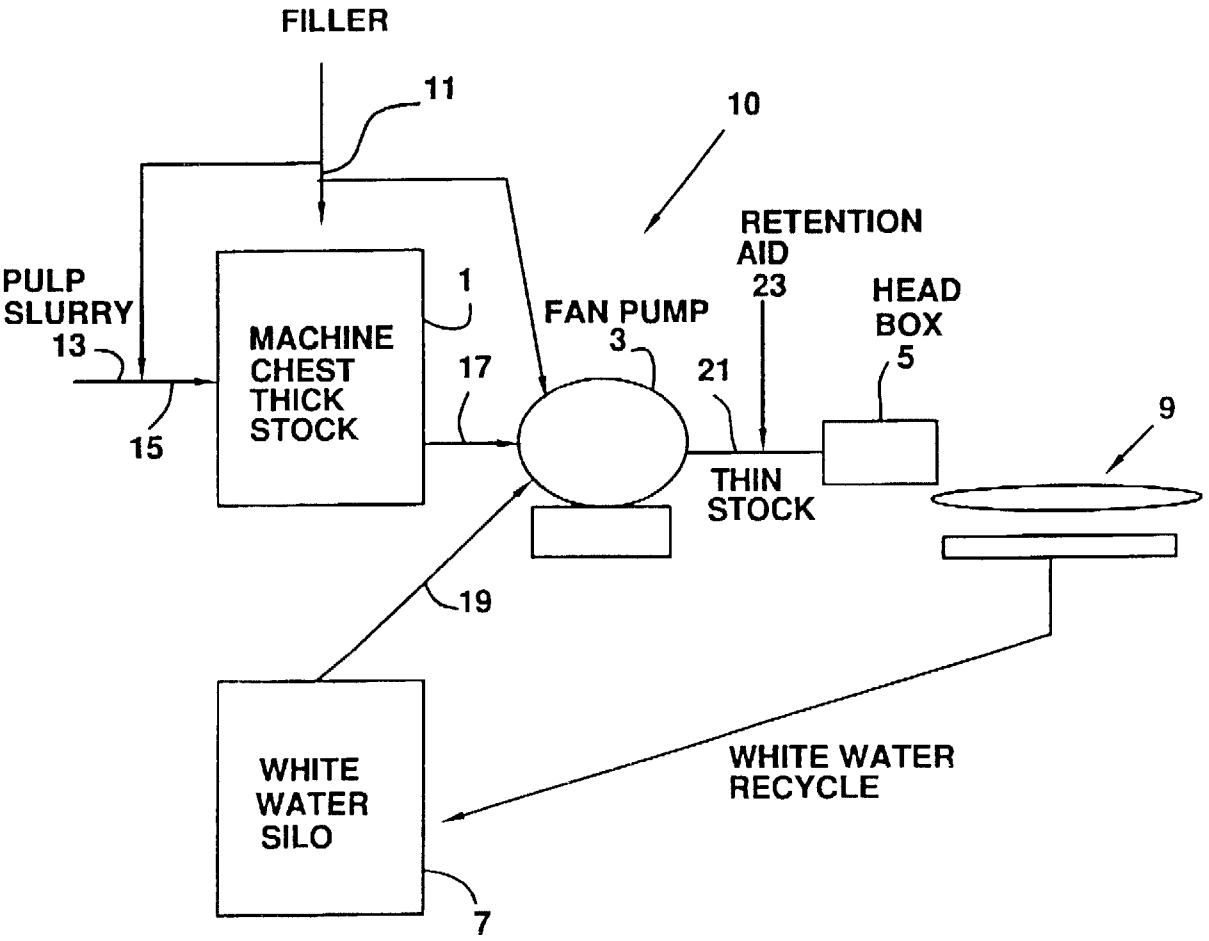
FIG. 1 PRIOR ART
FIG. 1 is a schematic block diagram of a portion of a prior art papermaking system.
Figure 2:
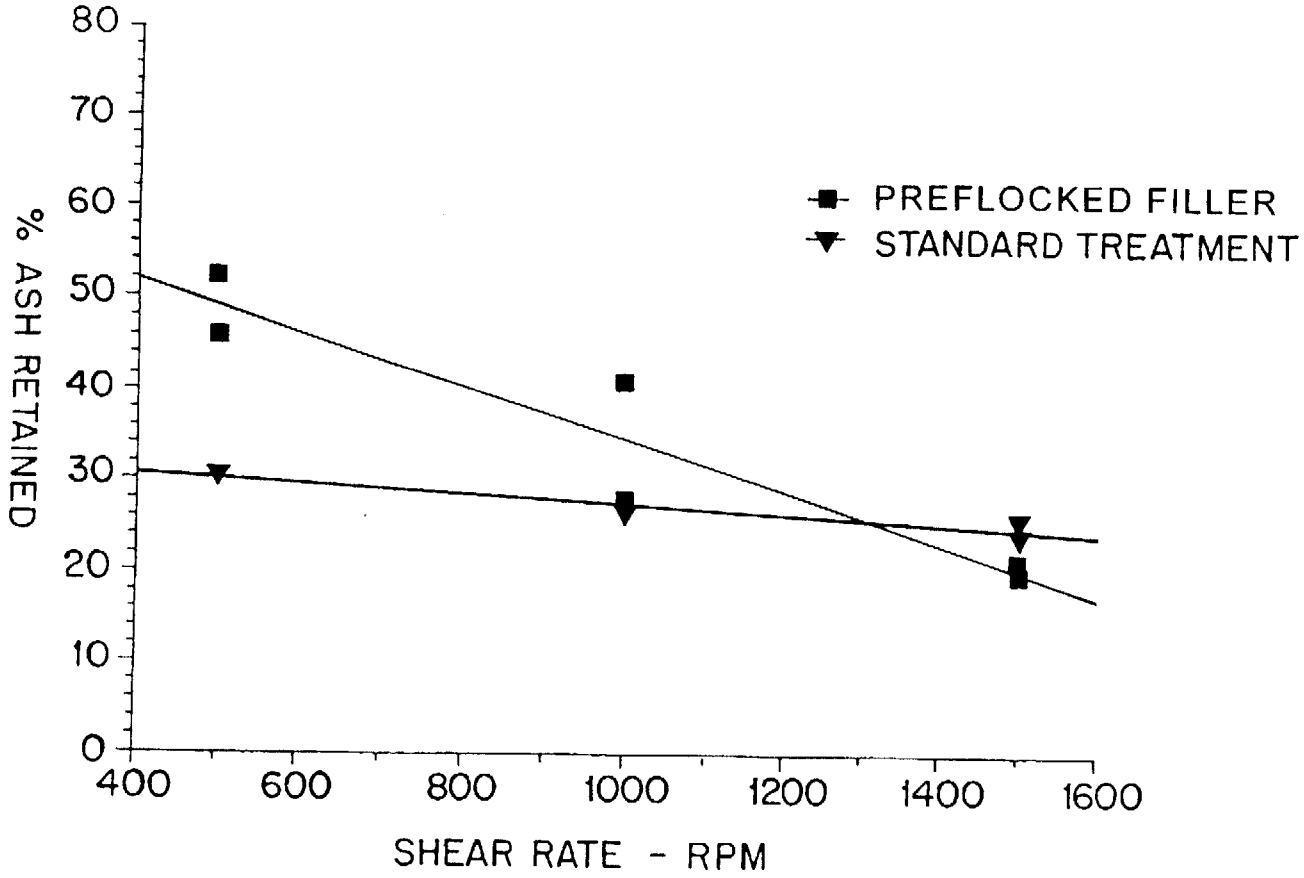
FIG. 2 PRIOR ART
FIG. 2 is a graph comparing the effective shear on preflocked filler and percent ash retention.
Figure 3:
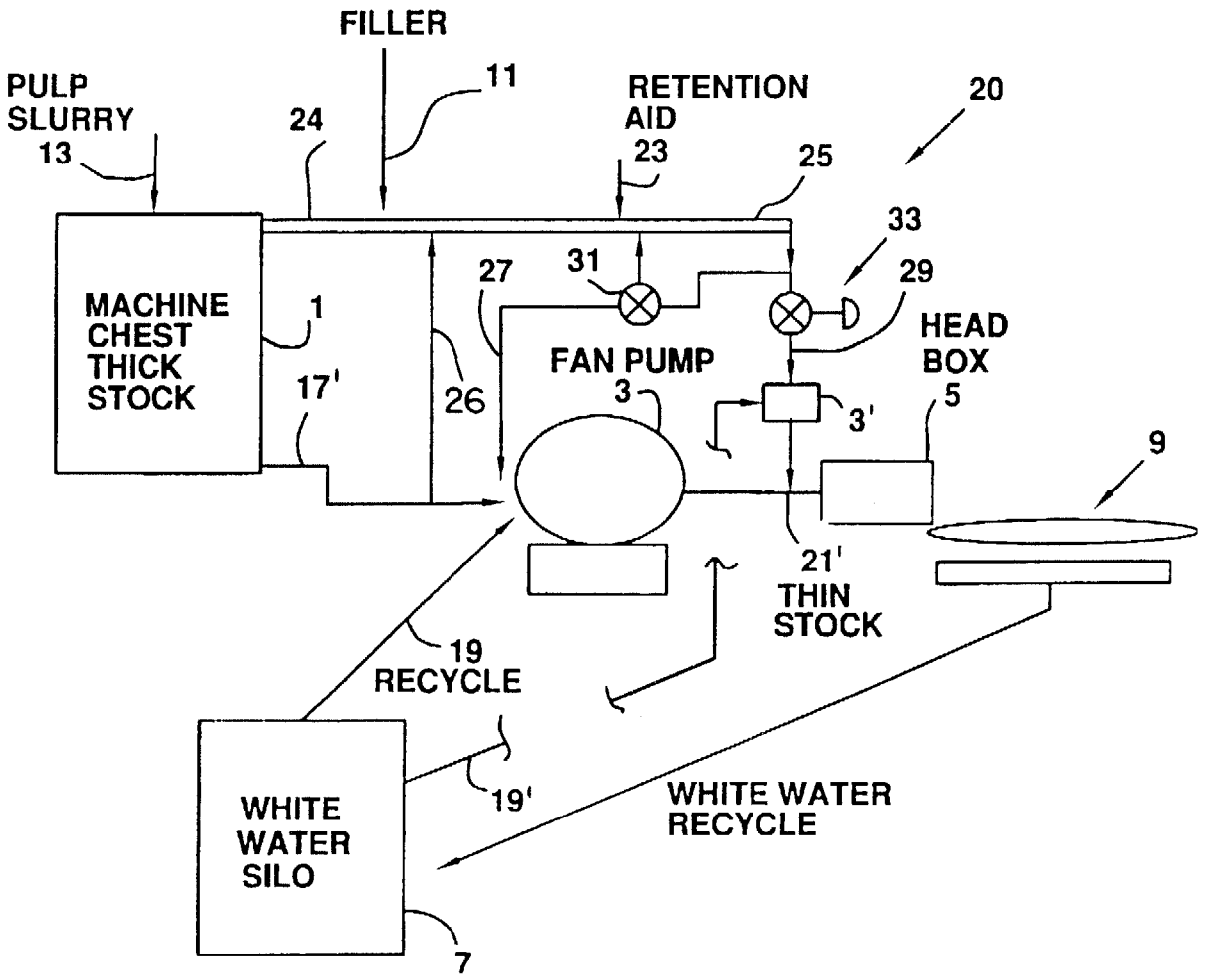
FIG. 3 is a schematic block diagram of a preferred embodiment of the inventive apparatus and method.

With reference now to FIG. 3, a preferred embodiment of the inventive method and apparatus is generally designated by the reference numeral 20. In this embodiment, similar components are used as depicted in FIG. 1. More specifically, a thick stock machine chest 1, a fan pump 3, a head box 5, a white water recycle silo 7 and a papermaking machine 9 are provided. A pulp slurry 13 is provided to the machine chest.

In accordance with the invention, the thick stock exiting the machine chest is split into two thick stock pulp slurry streams 17' and 24. Thick stock pulp slurry stream 17' is directed to the fan pump 3. The thick stock pulp slurry stream 24 receives the filler 11 and retention aid 23 in the desired amounts. With the addition of the filler 11 and retention aid 23, a filler and retention aid-containing thick stock pulp slurry 25 is formed. The pulp slurry 25 can then be split into streams 27 and 29. The pulp slurry 27 merges with the thick stock pulp slurry 17' and the white water recycle 19 upstream of the fan pump 3. Alternatively, the filler and retention aid-containing pulp slurry 25 can be added via stream 29 to the thin stock pulp slurry 21' upstream of the head box 5. In this mode, a fan pump 3' and white water recycle 19' can be disposed in stream 29 to build pressure in the stream 29, if necessary. Another fan pump could also be in stream 27, if necessary. Although two streams 27 and 29 are depicted, only a single split stream could be used and merged with the pulp slurry either upstream or downstream of the fan pump.

Valves 31 and 33 can be used to control diversion of the stream 25 to either the thick stock stream 17' or the thin stock stream 21'. Of course, any other means for controlling the flow between streams 27 and 29 can be utilized as would be known to those skilled in the art. In addition, overall control schemes can also be utilized for filler and retention aid addition as well as control of the flow rate in streams 24, 17', 27 and 29 as would also be within the skill of the art. If desired, more than two streams could emanate from the thick stock machine chest. In this mode, two of the three streams could receive filler and/or retention aid to improve filler retention percentage, lower retention aid cationic coagulant consumption and provide acceptable sheet appearance. Further, the thick stock could be split downstream of the machine chest 1 as represented by feed line 26.

Adding the desired amount of filler and retention aid to only a portion of the thick stock pulp slurry exiting the machine chest 1 provides significant benefits in the overall papermaking process. First, the retention aid 23 sees lesser amounts of the anionic trash present in the pulp slurry 13. Thus, lower amounts of cationic coagulant are needed when processing pulp containing high levels of anionic trash.

In addition, by segregating or splitting a small portion of the thick stock pulp slurry, more filler is needed to obtain the same overall ash level on the machine. Consequently, the filler and fiber are subjected to a preflocked situation in the stream 25. By concentrating the solution of fiber in the pulp slurry and the filler, the kinetics of reaction with the retention aid are shifted in favor of the filler instead of the dissolved colloidal material, i.e. the anionic trash, that would foul the polymeric retention aid 23.

This inventive method has applications in papermaking systems using any filler ranging from kaolin clay, calcium carbonate and talc to more exotic fillers such as aluminum trihydrate, magnesium hydroxide, calcined clay and precipitated silicas and silicates. Typical retention aids systems include Betz 1290 (anionic acrylamide) and Betz 230 (quaternary amine). Other polymers have also been shown to be applicable, ranging from Betz 8905 (branched cationic co-polymer), Nalco 7607 (quaternary amine) and Nalco 625 (anionic polyacrylamide), Nalco 713 (cationic polyacrylamide), polyethylene imine (PEI) from BASF, cationic starch and alum. Non-ionics, such as (Polyethylene oxide) would also work. The choice of the polymer is governed by the pulp system into which it is being introduced. Other retention aids are known in the art, can also be used.

Using the split flow of the invention, a significant increase in first pass retention is achieved in the papermaking system along with a significant reduction in retention aid consumption. In addition, the inventive system requires no more monitoring than a traditional system adding retention aids upstream of the head box.

A further benefit of the invention is realized on paper machines that contain high amounts of residual anionic material from ink that is carried over from the recycling process. If retention is increased on these types of machines, brightness is lost due to the retention of more of the residual ink. By using the split pulp flow system of the invention, the amount of the residual ink that is retained could be significantly reduced allowing simultaneous brightness gains and retention in these grades.

The flow rate of the stream 24 is dependent on several variables. For example, the flow rate and level of filler addition could be a function of the filler content in the pulp slurry going to the papermaking machine 9. In this instance, the flow rate for the stream 24, e.g. the secondary flow, could be determined by the following equation:

$$F=((C*T)/M)$$

where F =the secondary flow rate (Tons/hr.).

C =the percent of filler desired in the final sheet. (Normal ranges from 1 to 40%).

T =total production rate on single ply machines or production rate of a single ply on a multi-ply machine. Normal ranges from 1 ton/hr to 75 tons/hr. and M =the % filler in the secondary flow. Normal ranges 25 to 50%. (This is governed by the amount of anionic trash in the system, e.g., more or less than the normal 25–50%.)

Table 1 exemplifies three different examples for determining the split stream or secondary flow rate for different total production rates, different filler percents in the final sheet and different filler percentages in the secondary flow. Of course, other scenarios could be contemplated by those skilled in the art. It is believed that the overall ranges could include the following: 1 to 40% of percent filler in the final sheet product, 25 to 50% filler in the secondary flow, up to 100 tons/hr. as the total production rate.

TABLE 1

| | Case 1 | Case 2 | Case 3 |
|---|---|---|---|
| Total Production (T) | 75 Tons/hr. | 45 Tons/hr. | 15 Tons/hr. |
| Filler in Sheet, % (C) | 20 | 10 | 5 |
| Filler in Secondary Flow, % (M) | 30 | 40 | 50 |
| Secondary Flow Rate (F) | 50 Tons/hr. | 11.25 Tons/hr. | 1.5 Ton/hr. |

As described above, the inventive process is especially beneficial in systems containing anionic trash, that use an expensive specialty filler and/or use dirty recycled furnish. Quite unexpectedly, using the split stream approach results in simultaneous reduction in chemical retention aid usage, increased filler retention and acceptable sheet appearance.

Table 2 details an experimental study comparing the inventive process with a prior art system using no retention aid and one using two pounds of retention aid retention is increased and retention aid consumption is reduced when compared to the prior art systems.

TABLE 2

Retention of Filler Using New Process

| Polymer Dosage | | | | | Prior Art | Control |
|---|---|---|---|---|---|---|
| Betz 1290 | 0.24 | 0.18 | 0.13 | 0.10 | Control | No |
| Betz 230 (#/ton) | 0.36 | 0.26 | 0.20 | 0.16 | 2.0#/Ton Pulp[1] | Polymer |
| Estimated Polymer Cost $/ton Paper | 0.60 | 0.44 | 0.33 | 0.26 | 2.0 | — |
| First Pass Ash Retention % | 49.9 | 45.0 | 38.3 | 33.1 | 16 | 9.1 |
| Fiber/Filler Ratio, %[2] | 70/30 | 70/30 | 70/30 | 60/40 | 88/12 | 88/12 |

*sheets with acceptable appearance were reported. Higher Retention can be obtained by sacrificing appearance.

[1]Polymer added without split stream.

[2]Fiber/Filler Ratio is for the split flow only. This number will be governed by the amount of fiber diverted to the secondary stream.

Figure 4:
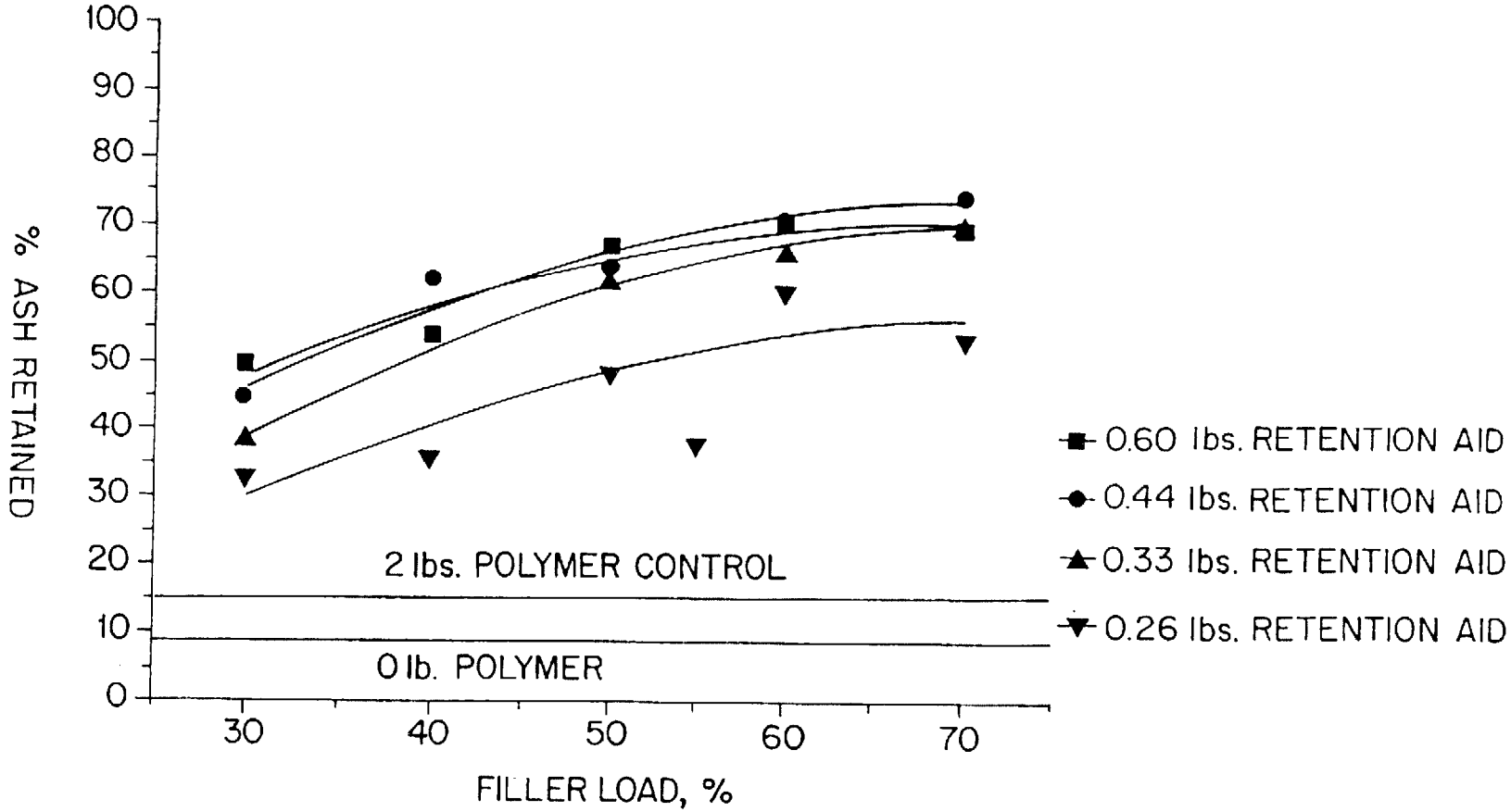
FIG. 4 is a graph 4 showing the effect of filler/fiber ratio on sheet appearance.

FIG. 4 graphically demonstrates the results exemplified in Table 2. Again, significantly improved first pass ash retention rates are achieved with lower retention aid consumption and acceptable sheet appearance over prior art systems. This comparative study confirms the unexpected results associated with the inventive split stream process and apparatus.

Although conventional apparatus have been described using the inventive process, it should be understood that other types of apparatus could be used to achieve the split stream filler/retention aid treatment described above as would be known in the art.

As such, an invention has been disclosed in terms of preferred embodiments thereof which fulfill each and every one of the objects of the present invention as set forth hereinabove and provides a new and improved method and apparatus for papermaking.

Of course, various changes, modifications and alterations from the teachings of the present invention may be contemplated by those skilled in the art without departing from the intended spirit and scope thereof. Accordingly, it is intended that the present invention only be limited by the terms of the appended claims.

We claim:

1. In a method of papermaking wherein a filler is added to a pulp slurry, a retention aid is added to the filler-containing pulp slurry and the pulp slurry with the filler and retention aid are fed to a paper machine, the improvement comprising:

a) separating the pulp slurry into at least a first and a second stream;

b) adding the filler and retention aid to the first stream; and c) adding the first stream containing the filler and retention aid back to the second stream;

d) whereby said retention aid is subjected to lesser amounts of anionic trash in the pulp slurry due to said separating step.

2. The method of claim 1 wherein said pulp slurry is fed to a thick stock machine chest forming a thick stock stream of pulp slurry and the thick stock stream of pulp slurry is separated into the first and second streams.

3. The method of claim 1 wherein said pulp is fed to a thick stock machine chest and the pulp slurry is separated into the first and second streams at one of the thick stock machine stock chest and a location downstream thereof, the second stream being fed to a fan pump to form a think stock pulp slurry, the first stream being fed to the second stream upstream or downstream of the fan pump, to form a mixed pulp slurry, the mixed pulp slurry then being fed to a headbox.

4. The method of claim 1 wherein the filler is selected from the group consisting of clay, calcium carbonate, talc, zinc sulfide, magnesium hydroxide, barium sulfate, calcium sulfate, aluminum trihydrate, titanium dioxide and precipitated silicates, precipitated silicas and combinations thereof.

5. The method of claim 1 wherein the retention aid is one of a cationic, anionic, non-ionic retention and/or a combination thereof.

6. The method of claim 1 wherein the amount of filler added to the first stream is a function of one of the percent amount of filler in the final paper product and an amount of anionic trash in the pulp slurry.

7. The method of claim 6 wherein the flow rate of the first stream is determined by the following formula $$F=(C\times T)/M$$

where F is the first stream flow rate in tons/Hr, C is the target percent filler in the final paper product, T is the total production flow rate in tons/Hr and M is the percent filler in the first stream.

8. The method of claim 1 wherein the retention aid is selected from the group consisting of a charge biasing polymer and a high molecular weight bridging polymer, hydrated aluminum sulfate, starch and combinations thereof.

9. The method of claim 8 wherein the charge biasing polymers comprise anionic acrylamide, a quaternary amine, cationic polyacrylamide, polyethylene imine, and anionic polyacrylamide.

10. The method of claim 1 wherein the filler is a kaolin clay.

* * * * *

UNITED STATES PATENT AND TRADEMARK OFFICE

CERTIFICATE OF CORRRECTION

PATENT NO. : 5,779,859
DATED : July 14, 1998
INVENTOR(S) : Richard Douglas Carter, et al.

It is certified that error appears in the above-identified patent and that said Letters Patent is hereby corrected as shown below:

At [56] References Cited, please add the following patents and publications

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 6 | 9 | 5 | 6 | 0 | 9 | 12/9/97 | Petander et al. | | | |
| | | | | | | | | | | | | | |

Signed and Sealed this

Twenty-third Day of February, 1999

*Attest:*

Q. TODD DICKINSON

*Attesting Officer*

*Acting Commissioner of Patents and Trademarks*